United States Patent [19]

Hunt

[11] 4,267,616

[45] May 19, 1981

[54] ROTARY SWEEPING BROOM

[75] Inventor: Frederick B. Hunt, Wauwatosa, Wis.

[73] Assignee: Milwaukee Dustless Brush Co., Milwaukee, Wis.

[21] Appl. No.: 942,778

[22] Filed: Sep. 15, 1978

[51] Int. Cl.[3] ..... A46B 7/10

[52] U.S. Cl. ..... 15/182; 15/82

[58] Field of Search ..... 15/179–182, 15/53 A, 53 AB, 82, 83, 79 R, 79 A, 21 D, 21 E

[56] References Cited

U.S. PATENT DOCUMENTS

| | | | |
|---|---|---|---|
| 667,305 | 2/1901 | Feix | 15/183 |
| 1,198,407 | 9/1916 | Beckett | 15/182 |
| 1,439,159 | 12/1922 | Frost | 15/182 |
| 3,193,866 | 7/1965 | Jones | 15/182 |
| 3,750,225 | 8/1973 | Gould et al. | 15/182 |
| 3,715,773 | 2/1973 | Drumm | 15/183 |
| 3,952,359 | 4/1976 | Rosseau | 15/182 |

FOREIGN PATENT DOCUMENTS

| | | | |
|---|---|---|---|
| 1232106 | 1/1967 | Fed. Rep. of Germany | 15/182 |

*Primary Examiner*—Edward L. Roberts

*Attorney, Agent, or Firm*—Andrus, Sceales, Starke & Sawall

[57] ABSTRACT

A rotary broom for street sweepers and the like includes a central core. A coiled sweeping brush means has one end affixed to the core and is helically wound around the core. The turns of the brush means are free to move on the core and the winding direction of the brush means is coordinated with the direction of rotation of the broom so that rotation of the broom on the street produces a circumferential movement of the brush means about the core which tightens the brush means on the core. The brush means may comprise a first coiled sweeping brush with one end affixed to the core and helically wound around the core in a first winding direction, typically toward the center of the core. A second coiled sweeping brush has one end affixed to the core and is wound in the opposite direction of winding toward the center of the core. The inner ends of the brushes may be coupled to a clip which permits the slack removing, circumferential movement about the core while restraining the ends for other movements together.

58 Claims, 12 Drawing Figures

ROTARY SWEEPING BROOM

BACKGROUND OF THE INVENTION

1. Field of the Invention

The present invention relates to rotary brushing implements.

2. Description of the Prior Art

Numerous types of apparatus employ rotary sweeping or brushing implements. Typical of such apparatus are street cleaners in which the rotating brushing implement is used to pick up trash off the street and place it on a conveyor or in a bin for disposal. In the street cleaner field, implements are often called "brooms" and the term is so used herein.

In a typical rotary broom in use today, the bristle portion is initially formed as a strip having a channel in which the bristles are seated and which is crimped to retain the bristles. The bristle portion is then placed on a core or mandrel to form the rotary broom.

Numerous kinds of brooms are currently available. In one such broom, the strip is helically wound around the mandrel and permanently affixed to the mandrel. The broom is sold as a prefabricated, disposable unit. This approach features easy, rapid replacement in the street cleaner but with shipping bulk and loss of the mandrel at each refill.

In another variation, the strip is severed and formed into doughnut-like wafers which are slid on the core between spacers. This approach permits reuse of the core and some reduction in shipping bulk but at higher installation cost.

In a further variation, a groove or track is provided along the exterior of the core into which a helical strip of bristles is threaded. Shipping bulk is minimized since the volume of the collapsed helix is small. But replacement of the strip becomes difficult as the track on the core becomes clogged with dirt and rust.

A recent development in rotary brooms utilizes a so-called "trackless core" in which the track or groove is omitted. See U.S. Pat. No. 3,750,225 to Gould. The ends of the strip are affixed to the ends of the core and the intermediate turns of the helical broom are free to move or "float" with respect to the core. Such a broom is small in shipping bulk and economical in replacement.

However, in use, the rotation of the broom on the street produces circumferential movement of the strip intermediate the ends of the strip. Existing designs have sought to remove the slack produced by this movement to avoid reducing the sweeping efficiency of the broom through imbalance and to prevent damage or eventual destruction of the broom. Slack removal also holds the strip tightly on the core during all operative states of the broom. U.S. Pat. No. 3,750,225 shows an automatic slack accumulator which takes up the slack at one end of the strip. However, an automatic slack accumulator may fail to work adequately in the service environment. U.S. Pat. No. 3,193,866 to Jones shows a tracked core broom with a non-automatic slack remover. The operation of the broom must be periodically stopped to remove the slack. This tends to be inefficient and impractical.

SUMMARY OF THE PRESENT INVENTION

The gist of the present invention is to use the circumferential movement of the sweeping brush on the core to lock the brush on the core during the sweeping operation while allowing the brush to somewhat loosely surround the core at the other times. Slack removers at one end of the strip, with their attendant complexity and cost may thus be dispensed with and a simple retainer employed to retain the brush on the core during both the operative and inoperative states of the broom.

To this end, the broom of the present invention includes a cental core extending along the axis of rotation of the broom. A coiled sweeping brush means has one end affixed to the core and is helically wound around the core along its periphery. The turns of the brush means are free to move on the core and the winding direction of the brush means is coordinated with the direction of rotation of the broom so that rotation of the broom on the street produces a circumferential movement of the brush means and its other end about the core which tightens the brush means on the core during sweeping. When the broom is lifted off the street, the brush means tends to loosen toward its original state on the core. A retainer is provided to retain the other end of the brush means on the core which permits circumferential movement in both directions about the core.

In another embodiment of the present invention, the brush means comprises a pair of oppositely wound, helically coiled sweeping brushes placed on the core and extending along its periphery. The outer or inner ends of the brushes are fastened to the core. The remaining portions of the brushes are free to move circumferentially about the core to take up any slack generated during rotation of the broom against the street.

For example, the outer end of a first helically coiled sweeping brush may be fastened to an end of the core. The remainder of the brush is placed on the central portion of the core in a given winding direction. The turns of the coil and its inner end are free to move about and along the core. A second helically coiled sweeping brush has its outer end fastened to the other end of the core. The turns of this brush are wound in the opposite direction from those of the first brush. The turns of the second brush lying on the core are also free to move about and along the core and extend toward the central portion of the core so that the inner end of the second brush is in proximity with the inner end of the first brush.

Since the inner ends of the first and second brushes are free and not affixed to the core, any slack generated during rotation of the broom against the street is taken up by circumferential movement of the turns and inner ends of the brushes about the periphery of the core. The opposite winding directions of the brushes insure that the movement of the inner ends of both brushes will be in the same direction about the core. Once the slack has been removed by the circumferential movement, the brushes lie tightly on the core without the need for a slack accumulator mechanism.

The inner ends of the two brushes may be left free of each other or may be joined together. Or, the inner ends may be coupled by a device which permits movement of the inner ends together and relative to each other circumferentially about the core, while restraining their movement in other directions or restraining them for movement together in other directions. The coupling means may comprise an angle piece or trough for receiving the inner end of one or both brushes. The coupling means may be fastened to the end of one of the brushes or to the core.

The initial one or two turns of the brushes adjacent the outer ends affixed to the drum may be held in longitudinal proximity with the outer end for providing a greater density of bristles at the ends of the broom which enhances the sweeping action of the broom.

In the alternative, the inner ends of the brushes may be affixed to the core and the outer ends left free for slack taking up movement. In use, the direction of rotation of such a broom would be opposite that of a broom in which the outer ends were affixed to the core.

DETAILED DESCRIPTION OF THE PREFERRED EMBODIMENT

Figure 1:
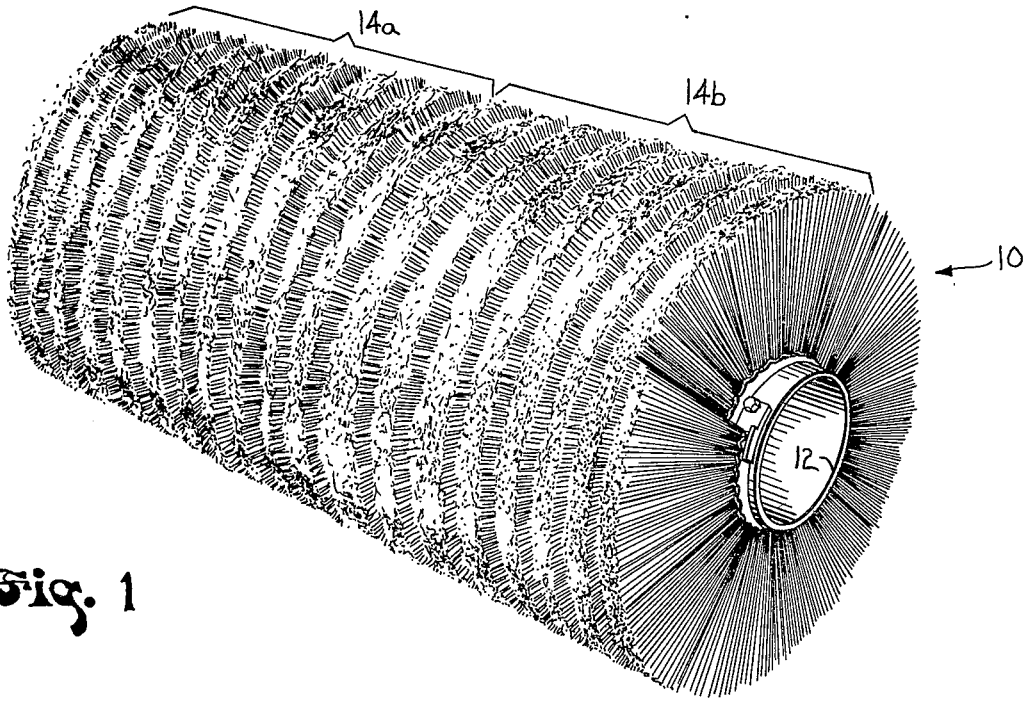
FIG. 1 is a perspective view of one embodiment of the improved rotary broom of the present invention.

FIG. 1 shows a rotary broom 10 constructed in accordance with the present invention. Rotary broom 10 includes core or mandrel 12 typically having a smooth exterior. Core 12 may be formed of steel, paper, fiber, or plastic tubing having dimensions appropriate for the apparatus, such as a street cleaner, with which the rotary broom is to be used. A pair of helically wound, strip-like brush elements 14*a* and 14*b*, hereinafter described in detail, are positioned about core 12.

Figure 3:
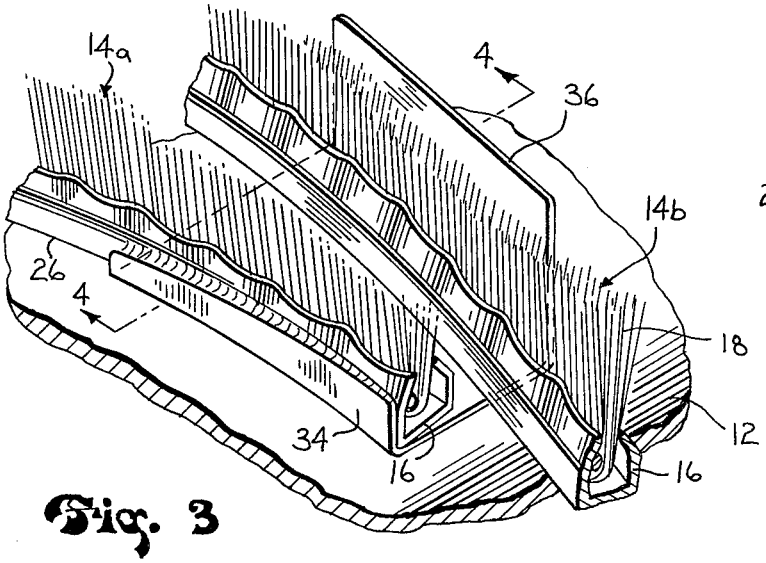
FIG. 3 is a perspective view of one embodiment of a coupling means for the inner ends of the brushes.
Figure 4:
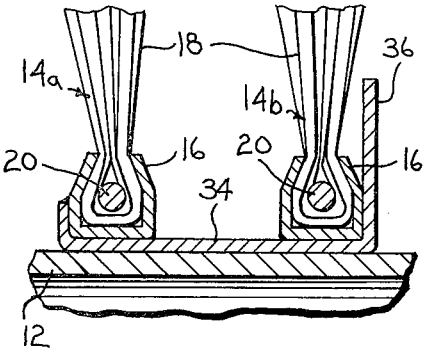
FIG. 4 is a cross-sectional view of the coupling means taken along the line 4—4 of FIG. 3.

A typical construction for brush elements 14*a* and 14*b* is shown in FIGS. 3 and 4. The brush elements consist of a channel 16 which receives bristles 18. Bristles 18 may be bent around anchor wire 20 lying in channel 16. Channel 16 is crimpled at its extremities to retain bristles 18 in the channel and is helically wound. It will be appreciated that other construction may be used to form a strip of bristles.

Figure 2:
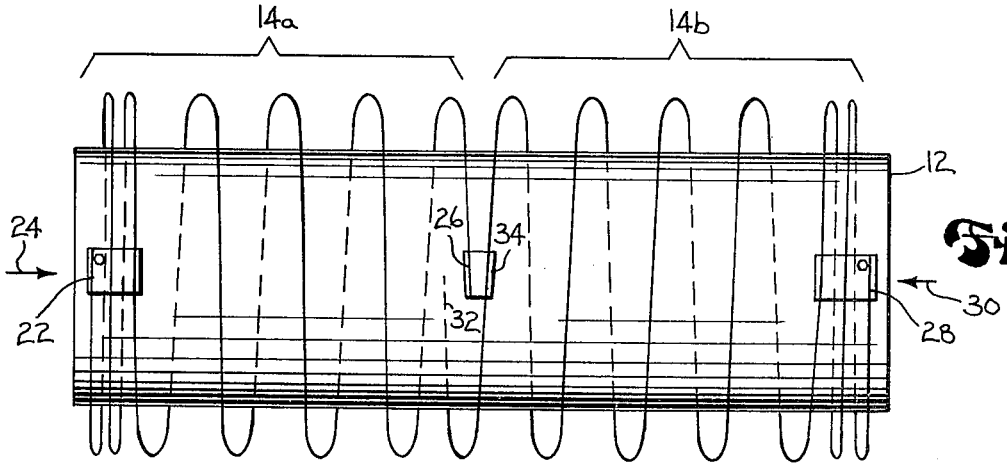
FIG. 2 is a schematic mechanical diagram showing details of the construction of the rotary broom shown in FIG. 1.

The placement of brushes 14*a* and 14*b* on core 12 may best be understood with the aid of the schematic diagram of FIG. 2. Outer end 22 of brush 14*a* is attached to one end of core 12 as in the manner hereinafter described in connection with FIGS. 7 and 8. The helical turns of brush 14*a* lie freely around core 12 in a given winding direction, for example, the clockwise winding direction when rotary broom 12 is viewed in the direction of arrow 24 in FIG. 2. The inner end 26 of brush 14*a* lies in the central portion of core 12.

Outer end 28 of brush 14*b* is attached to the other end of core 12. The helical turns of brush 14*b* also lie freely about core 12. The winding direction for brush 14*b* is opposite that of brush 14*a*, for example, the counterclockwise direction when rotary broom 10 viewed along arrow 30 in FIG. 2. The inner end 32 of brush 14*b* also lies in the central portion of core 12, in proximity to the free end 26 of brush 14*a*.

In the presently preferred embodiment of the invention, means are provided in rotary broom 10 for coupling the free ends of brushes 14*a* and 14*b* together. This means may comprise the trough-like clip 34 shown schematically in FIG. 2 and in detail in FIGS. 3 and 4. Clip 34 has a generally U-shaped configuration for receiving brushes 14*a* and 14*b*. As shown in FIG. 3, clip 34 is affixed to the free end of one of brushes 14*a* and 14*b*, for example, end 26 of brush 14*a*, as by welding one side of clip 34 to the channel 16 of the brush. The other of the brushes, for example brush 14*b*, rides in clip 34 for relative movement with respect to brush 14*a* and clip 34 in a direction along brush 14*b*. Heightened flange 36 may be provided in clip 34 to assist in retaining brush 14*b* in clip 34. As seen most clearly in FIG. 2, it is deemed preferable to have clip 34 engage a portion of brush 14*b* located at a distance along the brush of approximately one-half turn from the free end 32 of the brush. This prevents the gap in the turns of the brushes diametrically opposite clip 34 which would otherwise occur, as can be appreciated from FIG. 2. It also insures that the ends of the brushes will not become separated during the relative circumferential movement described below.

In operation, core 12 is mounted in the street cleaner and rotated about a horizontal axis. With the brush oriented as in FIG. 2, this rotation will be in the counterclockwise direction when rotary broom 10 is viewed in the direction of arrow 24. The friction developed between the rotating broom 10 and the street will tighten the turns of helical brushes 14*a* and 14*b* commencing adjacent the outer ends 22 and 28 of the brushes. When carried along the lengths of brushes 14*a* and 14*b*, this tightening will tend to cause slack in the inner portion of the brushes. However, this slack will be taken up by movement of the inner end 26 of brush 14*a*, clip 34, the inner end of brush 14*b*, and the portion of brush 14*b* lying in clip 34 circumferentially about the periphery of core 12. With rotating broom 10 instantaneously in the position shown in FIG. 2, the direction of this movement would be downwardly along the periphery of core 12. The inner ends of brushes 14*a* and 14*b* may move by different amounts by means of clip 34 to compensate for the individual structural characteristics of each brush. The turns of brushes 14*a* and 14*b* will thus become, and remain during sweeping, tightly wrapped about core 12 without the slack which has heretofore unbalanced the broom. Any subsequent movement of brushes 14*a* or 14*b* circumferentially or longitudinally about core 12 is minimized or precluded. However, when broom 10 is lifted off the street, brushes 14*a* and 14*b* loosen to their original state.

Figure 5:
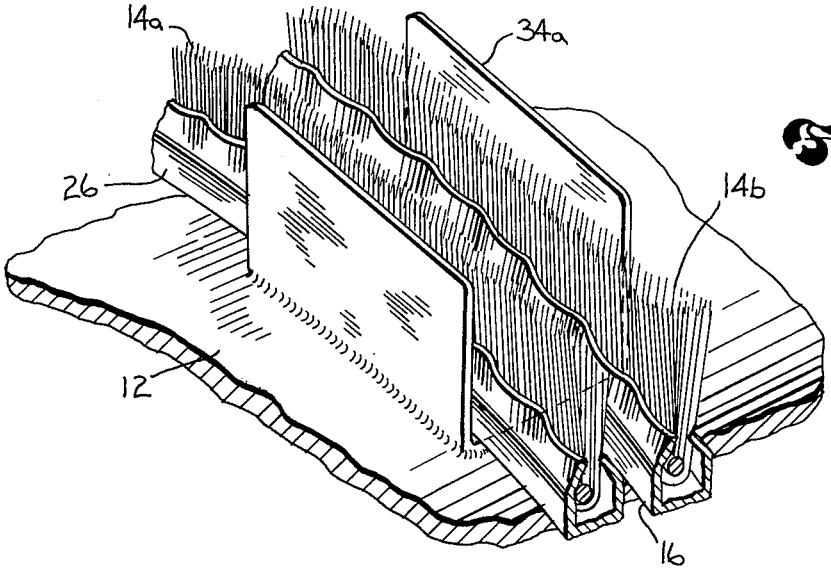
FIG. 5 is a perspective view of another embodiment of a coupling means for the inner ends of the brushes.

While clip 34 has been shown as fastened to one of the brushes 14*a* or 14*b* in FIGS. 2, 3, and 4, the clip may be affixed to core 12, as shown in FIG. 5 in connection with trough-like clip 34*a*. The inner portion of brush 14*b* is placed in clip 34*a* in much the same manner as with clip 34. The inner portion of brush 14*a* is placed in clip 34*a* sufficiently far from the inner end 26 to insure that circumferential movement of brush 14*a* with respect to clip 34*a* does not remove end 26 from the clip. Longitudinal movement of the inner ends 26 and 32 of the brushes along core 12 is limited with the use of clip 34*a*.

It will also be appreciated that the inner ends of brushes 14*a* and 14*b*, could, if desired, be uncoupled for relatively independent movement on core 12. Brushes 14*a* and 14*b* could be wound, during fabrication, in an extended spiral greater in length than one-half the length of core 12. When placed on core 12, the brushes would be axially compressed, urging the inner portions of the brushes into contiguity.

Figure 6:
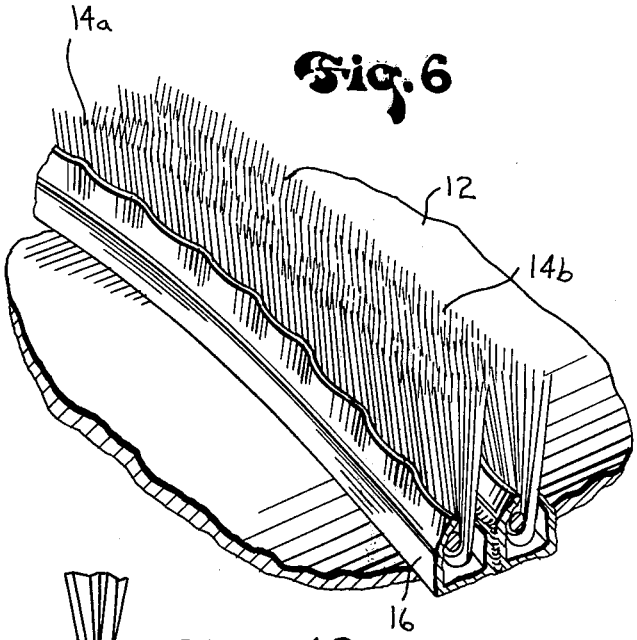
FIG. 6 is a perspective view of a further technique for coupling the inner ends of the brushes.

It will be further appreciated that under rather ideal conditions, the inner ends of brushes 14*a* and 14*b* will circumferentially move the same amount when slack in the brushes is taken up. The inner portions of brushes 14*a* and 14*b* could thus be connected directly together, preferably with an extra half-turn in one of the brushes to fill the winding gap in the broom, as seen in FIG. 6 in which the inner portions are shown as welded. Such ideal conditions would typically require a uniform circumference for core 12, uniform diameters in all turns of the helical brushes, similar brush length to the point of fixture, etc. However, in practice, such conditions may not occur so that relative rotary movment between brushes 14*a* and 14*b* should preferably be provided for as by the use of clip 34 or 34*a*.

Figure 7:
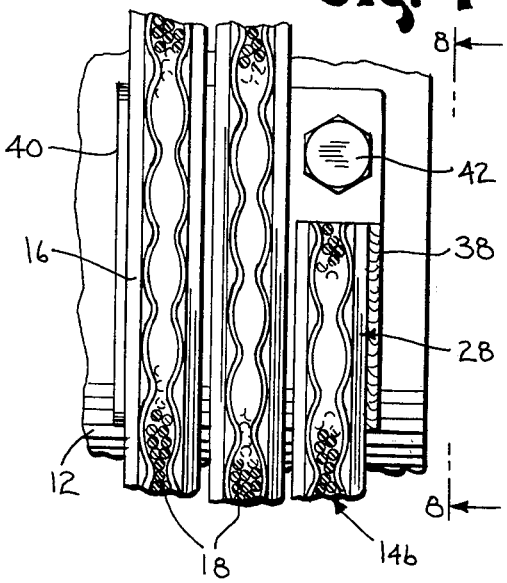
FIG. 7 is a plan view showing a means for attaching the fixed ends of the brush elements to the core.
Figure 8:
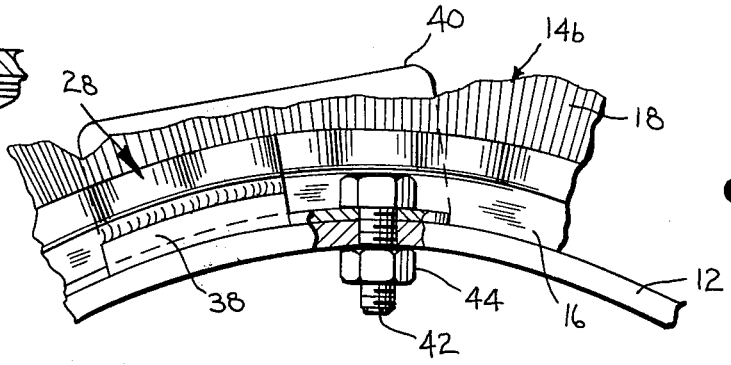
FIG. 8 is a side view of the attachment means taken along the lines 8—8 of FIG. 7.

An angle-like or trough-like clip 38 may also be used in conjunction with the fixed ends 22 and 28 of brushes 14*a* and 14*b*, as shown in FIGS. 7 and 8, to retain the first several turns of the brushes adjacent the outer ends of the brushes affixed to the core. This provides a greater density of bristles at the ends of the core which is an advantage in obtaining good, clean sweeping operation of the rotating broom when taken in conjunction with the curb and crown construction of the street being swept and the operation of the gutter brush with which most street cleaners are provided. FIGS. 7 and 8 show brush 14*b*. The fixed end 28 of brush 14*b* is fastened to angle-like clip 38 having flange 40. Clip 38 is bolted to core 12 by bolt 42 and nut 44. The first two turns of helical brush 14*b* lie in clip 38 and are thus restrained from longitudinal movement away from outer end 28 of brush 14*b* but not for circumferential movement about the periphery of core 12. Clip 38 may be mounted on core 12 with a clamping means for the end of the brush, if desired.

To replace brushes 14*a* and 14*b*, it is necessary only to loosen bolts and nuts 42 and 44. If the inner ends of brushes 14*a* and 14*b* are not fastened together, the ends are uncoupled and the brushes slid off the respective ends of core 12. If the ends of brushes 14*a* and 14*b* are fastened together, both brushes are slid off the same end of core 12. New brushes 14*a* and 14*b* are slid on core 12 at one or both ends, the outer ends fastened to core 12 and the inner ends coupled together. Rotating broom is then re-installed in the street cleaner.

Figure 12:
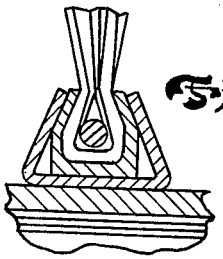
FIG. 12 is a cross-sectional view showing another embodiment for a core for the rotary broom of the present invention.

While the present invention is deemed to have its greatest utility in connection with the trackless core configuration described above, it may also find use with a tracked core. In this embodiment of the invention, a pair of tracks, wound in opposite directions, would be provided on the core. The brushes are placed in the tracks, as shown in FIG. 12, and fastened at their outer ends to the ends of the core. The inner portions are free for slack removing movement along the tracks.

Figure 9:
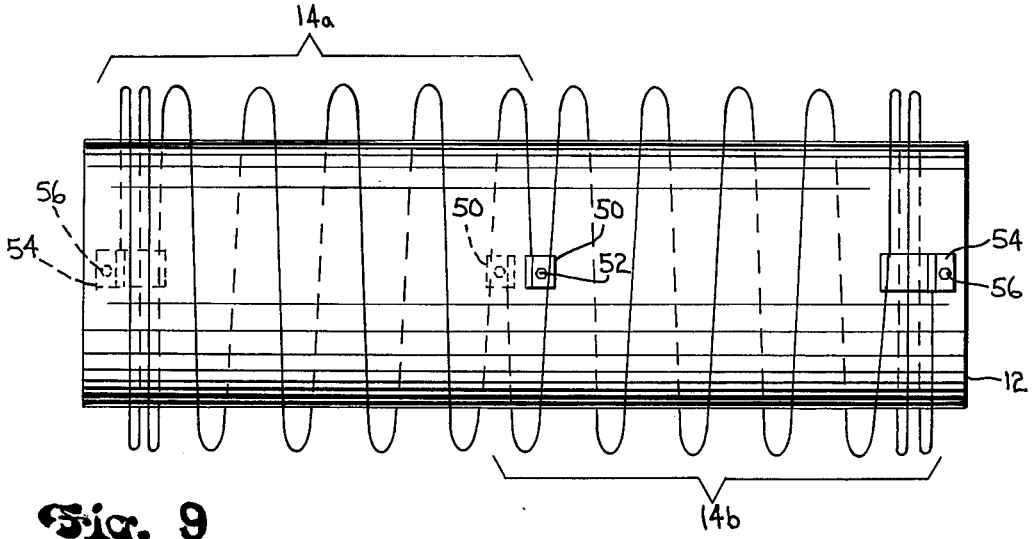
FIG. 9 is a schematic mechanical diagram showing details of the construction of another embodiment of the rotary broom of the present invention.

Further, and as schematically shown in FIG. 9, the inner ends of brushes 14*a* and 14*b* may be affixed to core 12 and the outer ends left free for slack taking up adjustment. The means for affixing each of the inner ends of brushes 14*a* and 14*b* to core 12 may comprise a plate 50 to which the inner end of the brush is attached. Plate 50 is bolted to core 12 by bolt 52. Or, a clamp for the inner end of the brush may be mounted on core 12.

Figure 10:
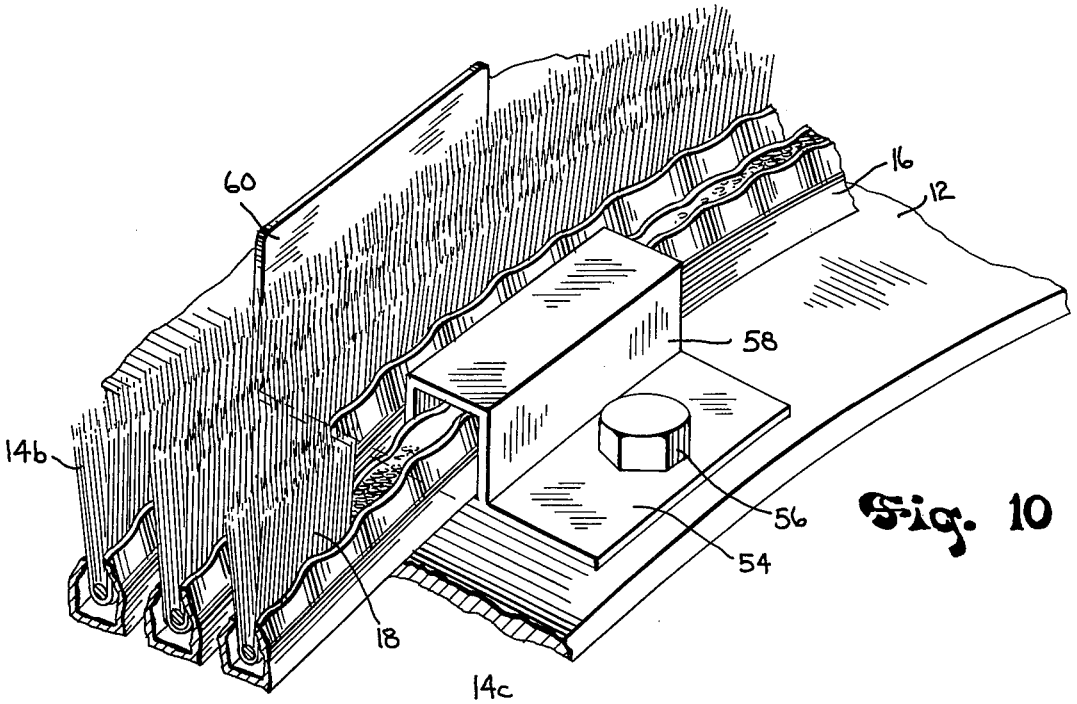
FIG. 10 is a perspective view of a means for retaining the outer ends of the brushes on the core in the embodiment of the invention shown in FIG. 9.

FIG. 10 shows a means for retaining the free end of brush 14*b* on core 12. Plate 54 is bolted to core 12 by bolt 56. Hoop 58, mounted on plate 54, receives the free end of brush 14*b*. Bristles 18 may be omitted from the extremity of the free end of brush 14*b* so that channel 16 extends through hoop 58. The free end of brush 14*b* is free to move circumferentially in either direction through hoop 58. Flange 60 retains additional turns of brush 14*b* in proximity to the end of core 12 to improve the sweeping operation, as described above. If desired, trough like elements, similar to element 34*a* may be used to retain the free ends of the brushes on the core.

With the inner ends of brushes 14*a* and 14*b* affixed to core 12, the direction of rotation of broom 10 will be opposite to that employed with the broom shown in FIG. 2, i.e., clockwise. The attachment of the inner ends of the brushes 14*a* and 14*b* may be circumferentially spaced about the periphery of core 12 as shown in FIG. 9, to provide uniform spacing of the turns of the brushes about the core. The positioning of the free ends of brushes 14*a* and 14*b* may be correspondingly peripherally positioned so as to provide an equal number of turns in each of the brushes.

Figure 11:
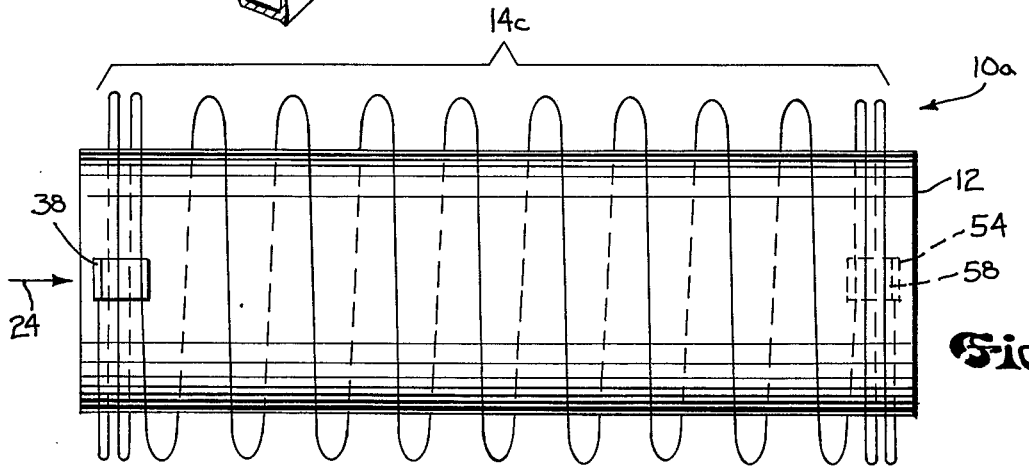
FIG. 11 is a schematic mechanical diagram showing details of the construction of another embodiment of the rotary broom of the present invention.

FIG. 11 shows an embodiment in which the brush element 14*c* of the broom 10*a* comprises a single helically coiled brush. One end of brush 14*c* is affixed to the end of core 12 as by a clip 38. The other, free, end of brush 14*c* is retained on core 12 by hoop 58-plate 54 arrangement similar to that shown in FIG. 10. The turns of brush 14*c* lie loosely about core 12. When broom 10*a* is rotated in the counterclockwise direction, as viewed in the direction of arrow 24 in FIG. 11 the circumferential movement of brush 14*c* tightens the brush on the core during the sweeping operation. The slack generated in the brush is taken up by circumferential movement of the free end of the brush through hoop 58. When broom 10*a* is lifted off the street, brush 14*c* loosens to its original state.

Various modes for carrying out the invention are contemplated as being within the scope of the following claims particularly pointing out and distinctly claiming the subject matter which is regarded as the invention.

I claim:

1. A rotary sweeping broom comprising:

a central core extendable longitudinally along the axis of rotation of the broom;

a helically coiled sweeping brush means having a first end attached to said core and having the turns extending along the periphery of said core, the turns and second end of said sweeping brush being free to move circumferentially about said core in an unrestrained manner in either direction of circumferential movement.

2. The rotary sweeping broom according to claim 1 including means operatively associated with said brush means for retaining the turns of said brush means adjacent at least one end of said core in proximity to each other.

3. The rotary sweeping brush according to claim 1 further including means operatively associated with said brush means for retaining said brush means on said core while permitting said unrestrained bi-directional circumferential movement.

4. The rotary sweeping broom according to claim 1 wherein said central core is further defined as having ends separated by a central portion; and wherein said brush means is further defined as comprising a first, helically coiled sweeping brush having a first end attached to an end of said core or said central portion of said core, said brush being wound around the exterior of said core in a first direction of winding from the point of attachment toward the other of said end or central portion, the turns and second end of said sweeping brush being free to move circumferentially about said core, and a second, helically coiled sweeping brush having a first end attached to another end of said core or said central portion of said core in correspondence with the attachment of said first brush to an end or central portion of said core, said second brush being wound around the exterior of said core from the point of attachment to the other of said end or central portion in a second direction of winding, opposite said first direction, the turns and second end of said second sweeping brush being free to move circumferentially about said core.

5. The rotary sweeping broom according to claim 4 including means operatively associated with at least one of said brushes for retaining at least one turn of said brush in proximity to the end of said brush adjacent the end of said core.

6. The rotary sweeping broom according to claim 4 wherein said first brush has its first end attached to an end of said core, said first brush being wound around the exterior of said core from said end of said core toward the center thereof, and said second brush has its first end attached to another end of said core, said second brush being wound around the exterior of said core from said end of said core toward the center thereof, the portions of said brushes adjacent the second ends thereof being in proximity to each other in the central portion of the core.

7. The rotary sweeping brush according to claim 6 wherein said first and second brushes are further defined as being wound for retaining said second end adjacent portions of said first and second brushes in proximity to each other.

8. The rotary sweeping broom according to claim 7 wherein said first and second sweeping brushes are wound in an extended spiral tending to urge said second end adjacent portions of said brushes into contiguity when placed on said core.

9. The rotary sweeping broom according to claim 6 further including means coupling said second end adjacent portions of said first and second brushes together.

10. The rotary sweeping broom according to claim 9 wherein said coupling means is further defined as permitting relative circumferential movement between the second end adjacent portions of said brushes about the exterior of core.

11. The rotary sweeping broom according to claim 10 wherein said coupling means is further defined as means for coupling said second end adjacent portions together for permitting said portions to move circumferentially together while also permitting relative circumferential movement between said portions.

12. The rotary sweeping broom according to claim 11 wherein said coupling means comprises a coupling member mounted on said core for receiving the second end adjacent portions of said first and second brushes.

13. The rotary sweeping broom according to claim 12 wherein said coupling member receives said second end adjacent portions at points removed from the second ends of said brushes.

14. The rotary sweeping broom according to claim 13 wherein said coupling means receives said second end adjacent portion of one of said brushes at a point removed approximately one-half turn back from the second end of the brush.

15. The rotary sweeping broom according to claim 10 wherein said coupling member is trough-like in shape.

16. The rotary sweeping broom according to claim 10 wherein said coupling means is further defined as means for coupling said second end adjacent portions together for permitting said second end adjacent portions to move circumferentially and longitudinally together, while also permitting relative circumferential movement between said portions.

17. The rotary sweeping brush according to claim 16 wherein said coupling means comprises a coupling member mounted adjacent the second end of one of said brushes for receiving the second end adjacent portion of the other of said brushes.

18. The rotary sweeping broom according to claim 17 wherein said coupling member is mounted on the second end of one of said brushes and receives the other of said brushes at a point removed from the second end of the other brush.

19. The rotary sweeping broom according to claim 18 wherein said coupling member receives said other brush at a point removed approximately one-half turn back from the second end of said other brush.

20. The rotary sweeping broom according to claim 17 wherein said coupling member has a flange for retaining said other brush in said member.

21. The rotary sweeping broom according to claim 6 wherein said second end adjacent portions of said first and second brushes are fastened together.

22. The rotary sweeping broom according to claim 21 wherein said brushes are fastened together at a point removed from the second end of one of the brushes.

23. The rotary sweeping broom according to claim 22 wherein said brushes are joined together approximately one-half turn back from the second end of one of the brushes.

24. The rotary sweeping broom according to claim 4 including means operative associated with at least one of said brushes for retaining at least one turn of said brush in proximity to the attachment of the first end of said brush to the end of said core.

25. The rotary sweeping broom according to claim 2, 5 or 23 wherein said means includes a flange for retaining said turn in proximity to said outer end attachment.

26. The rotary sweeping broom according to claim 24, wherein said retaining means permits circumferential movement of the turns of the brush.

27. The rotary sweeping broom according to claim 4 wherein said first brush has its first end attached to the central portion of said core, said first brush being wound around the exterior of said core from said central portion of said core toward an end thereof and said second brush has its first end attached to the central portion of said core adjacent the first end of said first brush, said second brush being wound around the exterior of said core from said central portion toward another end thereof.

28. The rotary sweeping broom according to claim 27 wherein the attachments of said first ends of said first and second brushes are circumferentially spaced on said core.

29. The rotary sweeping broom according to claim 28 wherein the attachment of said first ends of said first and second brushes are circumferentially spaced by 180° on said core.

30. The rotary sweeping broom according to claim 27 including means for retaining turns of said brushes adjacent the ends of said core in proximity to each other.

31. The rotary sweeping broom according to claim 1, 2, or 6 wherein said core has a substantially smooth exterior surface.

32. The rotary sweeping broom according to claim 1, 2, or 4 wherein said brush means is mounted in a track on said core.

33. A rotary broom brush structure for use on a central core having an axially extending peripheral surface, said structure comprising a first helically coiled sweeping brush placeable on the core for loosely embracing same along a first portion of the peripheral surface, said first brush being wound in a first direction of winding; and a second helically coiled sweeping brush axially alignable with first brush and placeable on a second portion of the core for loosely embracing its peripheral surface, said second brush being wound in a second winding direction opposite said first winding direction, said brushes having selected corresponding ones of their ends anchorable on said core, the remaining portions of said brushes being suitable for unrestrained bi-directional circumferential movement about said core, said brushes having inner end portions suitable for being placed in contiguity with each other when in axial alignment.

34. The brush structure according to claim 33 wherein the combined length of said first and second brushes when in axial alignment exceeds that of the core.

35. The brush structure according to claim 33 wherein said brush structure includes means coupling the inner end portions of said first and second brushes together.

36. The brush structure according to claim 35 wherein said coupling means is further defined as permitting relative circumferential movement between the inner end portions of said brushes.

37. The brush structure according to claim 35 wherein said coupling means comprises a coupling member mounted along the inner end portion of one of said brushes for receiving the inner end portion of the other of said brushes.

38. The brush structure according to claim 37 wherein said coupling member is mounted on the inner end of one of said brushes and receives the other of said brushes at a point removed from the inner end of the other brush.

39. The brush structure according to claim 38 wherein said coupling member receives the other brush at a point removed approximately one-half turn back from the inner end of said other brush.

40. The brush structure according to claim 37 wherein said coupling member has a flange for retaining said other brush in said member.

41. The brush structure according to claim 33 wherein the inner end portions of said first and second brushes are fastened together.

42. The brush structure according to claim 41 wherein said brushes are joined together at a point removed from the inner end of one of the brushes.

43. The brush structure according to claim 33 wherein said brushes include means for retaining turns of said brushes adjacent the outer ends of said brushes in proximity to each other.

44. The brush structure according to claim 33 wherein the inner end portions of said brushes have means for attaching the ends to said core.

45. The brush structure according to claim 33 wherein the outer end portions of said brushes have means for attaching the ends to said core.

46. An element for use in a plural brush rotary sweeping broom having a central core of predetermined longitudinal dimension having means for anchoring a pair of oppositely wound helically coiled brushes, said element comprising a helically coiled sweeping brush positionable on the core for loosely embracing its periphery, said brush having a longitudinal dimension approximately one-half the longitudinal dimension of the central core, said brush having means on one end for anchoring said brush on said core and a remaining portion suitable for unrestrained bi-direction circumferential movement about said core.

47. The element according to claims 46 wherein said brush further includes means retaining at least one turn of said brush in proximity to said one end of said brush.

48. The element according to claim 47 wherein said retaining means permits circumferential movement of the turns of said brush.

49. The element according to claim 46 wherein said brush further includes means on said remaining portion suitable for coupling said remaining portion to the remaining portion of another helically coiled sweeping brush adjacently positioned on said core.

50. The element according to claim 49 wherein said coupling means is a trough-like coupling member.

51. A rotary broom core suitable for use with a pair of oppositely wound, axially aligned, helically coiled sweeping brushes positionable upon the exterior thereof and having outer end portions and contiguous inner end portions, said core presenting a generally smooth, uninterrupted cylindrical exterior surface and having ends separated by a central portion, said core having means suitable for attaching an outer end portion of one of the brushes to each end of the core and coupling means mounted on the core suitable for receiving the inner end portions of the brushes at the central portion of the core and permitting unrestrained bi-directional circumferential movement of the inner end portions of the brushes on the core.

52. A rotary broom core suitable for use with a pair of oppositely wound, axially aligned, helically coiled sweeping brushes positionable upon the exterior thereof and having outer end portions and contiguous inner end portions, said core presenting a generally smooth, uninterrupted cylindrical exterior surface and having ends separated by a central portion, said core having means suitable for attaching the inner end portions of the brushes to the central portion of the core and means mounted on the core suitable for receiving the outer end portions of the brushes at the core ends and permitting unrestrained bi-directional circumferential movement of the outer end portions of the brushes on the core.

53. The core according to claim 51 wherein said coupling means couples the inner end portions of said first and second brushes together.

54. The core according to claim 51 including means for retaining at least a turn of at least one of said brushes in proximity to the attachment of the outer end portion of said brush to the end of the core.

55. The core according to claim 54 wherein said means includes a flange for retaining said turn in proximity to said outer end attachment.

56. The core according to claim 51 wherein said core includes oppositely wound helical tracks on said exterior for receiving said brushes.

57. The element according to claim 46 wherein said brush has a longitudinal dimension greater than one-half the longitudinal dimension of the central core.

58. A rotary broom core suitable for use with an axially extending helically coiled sweeping brush positionable on the exterior thereof, said core having means adjacent one end thereof for attaching an end of the brush to the core and having means adjacent the other end thereof for retaining the other end of the brush on the core while permitting unrestrained bi-directional circumferential movement of said other end of the brush on the core.

* * * * *